US005913663A

United States Patent [19]

Erkkilae et al.

[11] Patent Number: 5,913,663

[45] Date of Patent: Jun. 22, 1999

[54] DEVICE FOR REGULATING THE TOTAL POWER OF AT LEAST TWO VARIABLE DISPLACEMENT HYDROSTATIC PUMPS

[75] Inventors: Mikko Erkkilae; Karl-Heinz Vogl, both of Horb; Günter Fertig, Wertheim am Main; Felix zu Hohenlohe, Künzelsau-Amrichshauser, all of Germany

[73] Assignee: Brueninghaus Hydromatik GmbH, Germany

[21] Appl. No.: 08/693,284

[22] PCT Filed: Feb. 2, 1995

[86] PCT No.: PCT/EP95/00382

§ 371 Date: Aug. 14, 1996

§ 102(e) Date: Aug. 14, 1996

[87] PCT Pub. No.: WO95/22694

PCT Pub. Date: Aug. 24, 1995

[30] Foreign Application Priority Data

Feb. 18, 1994 [DE] Germany ..... 44 05 234

[51] Int. Cl.[6] ..... F04B 49/00

[52] U.S. Cl. ..... 417/216; 417/222.1; 417/287; 60/428; 60/443; 60/445

[58] Field of Search ..... 417/216, 222.1, 417/222.2, 287; 60/428, 443, 445

[56] References Cited

U.S. PATENT DOCUMENTS

| | | | |
|---|---|---|---|
| 4,809,504 | 3/1989 | Izumi et al. | 60/430 |
| 4,870,819 | 10/1989 | Walzer | 60/442 |
| 5,176,504 | 1/1993 | Moriya et al. . | |
| 5,182,908 | 2/1993 | Devier et al. | 60/420 |
| 5,251,440 | 10/1993 | Bong-dong et al. | 60/329 |
| 5,333,997 | 8/1994 | Hormann et al. | 417/216 |
| 5,428,958 | 7/1995 | Stenlund | 60/327 |
| 5,527,156 | 6/1996 | Song | 417/2 |
| 5,554,007 | 9/1996 | Watts | 417/222.1 |
| 5,575,148 | 11/1996 | Hirata et al. | 60/445 |
| 5,576,962 | 11/1996 | Ferguson et al. | 364/431.03 |
| 5,630,317 | 5/1997 | Takamura et al. | 60/445 |

FOREIGN PATENT DOCUMENTS

| | | |
|---|---|---|
| 0 232 722 A2 | 8/1987 | European Pat. Off. . |
| 42 08 925 C1 | 6/1993 | Germany . |

*Primary Examiner*—Timothy S. Thorpe
*Assistant Examiner*—Ehud Gartenberg
*Attorney, Agent, or Firm*—Scully, Scott, Murphy & Presser

[57] ABSTRACT

A total power regulation device for a plurality of variable displacement pumps (1, 2), each having a regulation valve (18) which regulates its displacement volume, which is acted upon—against a counter-pressure—by a control pressure corresponding to the working pressure of the variable displacement pump. When the control pressure exceeds the counter-pressure, the regulation valve regulates the variable displacement pump along a characteristic line (KL) of constant torque. To adjust the desired values of the individual drive torques simply, and to prevent torques from exceeding a desired value, an electronic control unit (16)—connected to measuring detectors (25) for detecting the displacement volumes of the variable displacement pumps—stores the desired value totals of the counter-pressures and the torque characteristic lines (KL) of the variable displacement pumps, and has a desired value setting device (27) for dividing the desired value total. The electronic control unit sets the torque characteristic lines ($KL_1$, $KL_2$) and sends control signals to the associated control elements (24) for generating counter-pressures which correspond to the predetermined counter-pressure desired values. The electronic control unit, upon response of each regulation valve, determines the working pressure (p)—along the torque characteristic line ($KL_1$, $KL_2$)—corresponding to the displacement volume (V), and processes the working pressure to a control signal for the control element for generating a counter-pressure.

6 Claims, 1 Drawing Sheet

Figure 1:
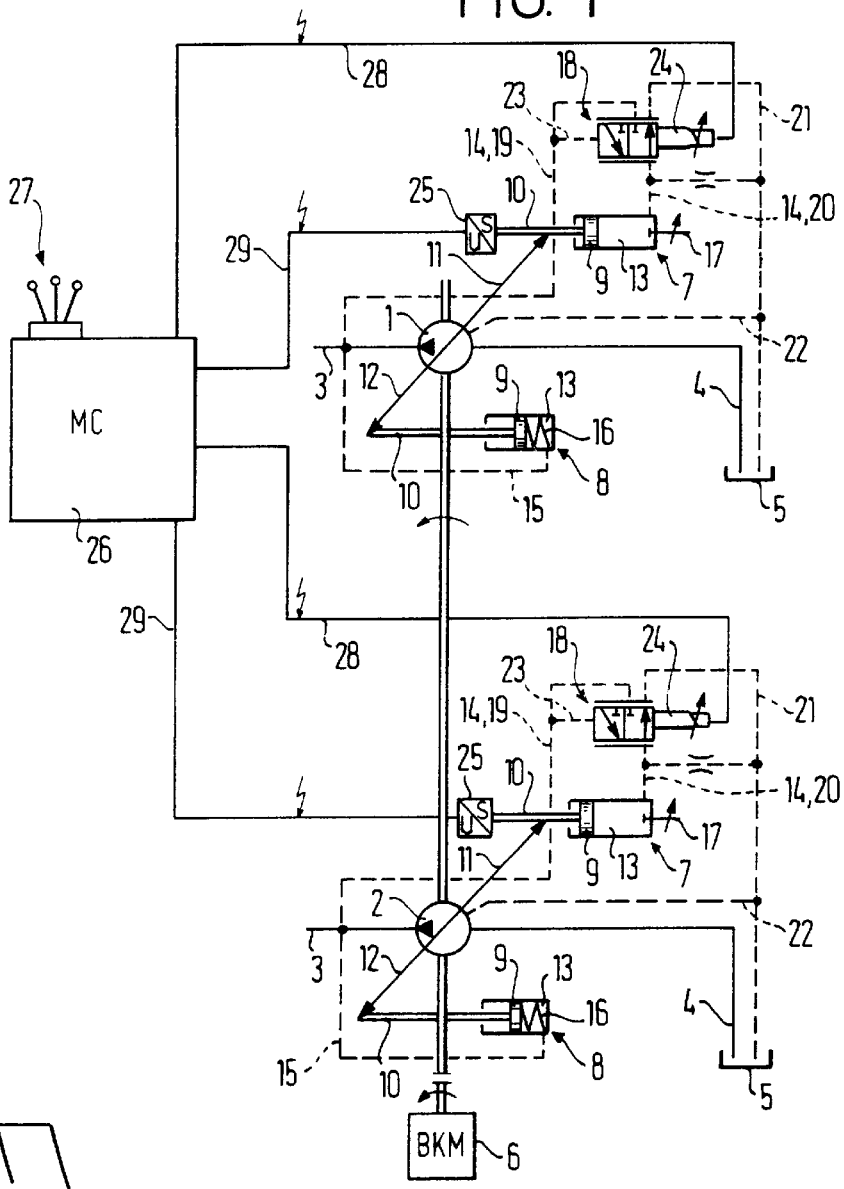

DEVICE FOR REGULATING THE TOTAL POWER OF AT LEAST TWO VARIABLE DISPLACEMENT HYDROSTATIC PUMPS

The invention relates to a device for regulating the total power of at least two variable displacement hydrostatic pumps a device for total power regulation of at least two variable displacement hydrostatic pumps (1, 2) driven by a common drive motor (6). Each pump delivers into a working line (3), by adjustment of its displacement volume by setting devices (7–12), which are acted upon by a setting pressure and are biassed towards a maximum displacement volume. A regulation valve (18) is associated with each setting device, and each regulation valve is acted upon, against a counter-pressure, by a control pressure corresponding to a working pressure in the working line (3) of the variable displacement pump (1, 2), adjusted by the setting device (7–12). The regulation valve (18), in response to the control pressure being greater than the counter-pressure, regulates the pressure set by the setting devices (7–12) to reduce the displacement volume of the variable displacement pump (1, 2) to maintain constant the product of working pressure and displacement volume.

Such a device is known for example from DE-PS 42 08 925. The total power regulation of this known device distributes the total drive power made available from the drive motor between the two variable displacement pumps. It is based, as with any power regulator, on the principle of adjustment of the displacement volumes of the variable displacement pumps in dependence upon the working pressure such that the maximum drive torque in each case, or with constant drive speed of rotation, the maximum power take up of the variable displacement pumps in each case, remains substantially constant over the entire working range.

The working pressure generated by each variable displacement pump acts, with the known device, as control pressure on the respective associated regulation valve via a pressure piston and a lever arm of a double-armed pivot lever acted upon by this pressure piston. The pressure piston is displaceably arranged in the setting piston of the respectively associated setting device, constituted as a setting cylinder, and acts in such a manner on the lever arm that its lever length is so shortened upon displacement of the setting piston in the sense of a reduction of the displacement volume of the variable displacement pump that the working pressure can increase in the same ratio as the displacement volume of the variable displacement pump reduces. In this way, the product of working pressure and displacement volume is held constant.

The counter-pressure at each regulation valve is generated by two settable compression springs, of which one acts directly on the regulation valve and the other acts on the regulation valve via the lever arm of the pivot lever acted upon by the control pressure. A further control pressure, which corresponds to the working pressure generated by the respective other variable displacement pump, acts against the pressure of the compression spring acting upon the lever arm. The sum of the setting values of the two compression springs determines the maximum torque of the respective variable displacement pump concerned and corresponds to the total drive torque of the drive motor. This torque can be transmitted from each variable displacement pump so long as no second control pressure arises at the associated regulation valve, i.e. so long as the respective other variable displacement pump takes up no torque.

With increasing torque take-up of the latter variable displacement pump the counter-pressure at the regulation valve of the first variable displacement pump is reduced as a consequence of the corresponding increase of the further control pressure, and therewith the torque setting of the first variable displacement pump is reduced, down to a minimal value, which then occurs when the further control pressure is the same as or larger than the pressure of the compression spring acting on the lever arm. Therewith, the torque take-up of each variable displacement pump is restricted to a value (desired value of the individual drive torque) which corresponds to the setting value of the respective associated compression spring acting directly on the regulation valve concerned. A higher torque take-up of each of the two variable displacement pumps is possible in the case when the desired value of the respective individual drive torque is increased through corresponding alteration of the setting value of the compression spring directly acting upon the respective regulation valve, and as consequence thereof also the setting value of the three remaining compression springs is increased, or when the torque take-up of the respective other variable displacement pump falls below the setting value of the compression spring acting directly upon the associated regulation valve.

It is the object of the invention to so further develop a device of the kind mentioned in the introduction that the desired values of the individual drive torques of the variable displacement pumps can be adjusted in simple manner and that a torque take-up exceeding the respective set value is prevented.

This object is achieved by an electronic control unit (26) having a memory for storing, for each variable displacement pump (1, 2), data defining characteristic lines (KL)—of working pressure p in dependence upon displacement volume V—of constant torque, and the desired value total of counter-pressures at the regulation valves (18). The electronic control unit (26) includes a desired value setting device (27) for dividing the desired value total into desired values of magnate associated with each variable displacement pump, and sets—in correspondence to the counter-pressure predetermined desired values—the characteristic lines ($KL_1$, $KL_2$), and processes the predetermined desired values to a control signal for the electrical control element (24) to generate a corresponding counter-pressure at the regulation valve (18). Measuring detectors are connected to the electronic control unit (26), for detecting the displacement volume of each variable displacement pump (1, 2).

The electronic control unit (26), upon response of each regulation valve (18), determines—on the basis of the characteristic line ($KL_1$ or $KL_2$) set for each variable displacement pump (1 or 2)—a working pressure (p) which corresponds on the characteristic line ($KL_1$, $KL_2$) to the displacement volume (V) detected by the measuring detector (25). The control unit processes the working pressure (p) to a control signal for the control element (24) to generate a counter-pressure at the regulation valve (18). The desired values of the individual drive torques are predetermined in the simplest manner by means of the desired value setting device, whereby the electronic control unit divides the desired value sum stored in its memory part—which sum preferably corresponds to the total drive torque of the drive motor—in accordance with the desired value setting selected and by means of control of the electric control elements, preferably formed as force-regulated proportional magnets, with control signals which correspond to the predetermined desired values, sets the regulation valves to corresponding counter-pressures and thereby determines the respective maximum torques of each of the variable displacement pumps. The time consuming and relatively inexact setting of four compression springs, necessary in accordance with the prior art, no longer arises. Since the predetermined desired value of the individual drive torque for each variable displacement pump can be altered through division anew of the desired value sum by means of the desired value setting device, a torque take-up of the variable displacement pump exceeding the respectively set desired value is, in contrast to the device known from the prior art, not possible, there being yielded a desired value change so to say automatically with changing torque take-up of the respective other variable displacement pump. The device in accordance with the invention is, with regard to its hydraulic system, considerably more simply constructed than the device known from the prior art which needs the compression springs, the pivot levers, the pressure pistons displaceable in the setting pistons of the setting devices and the hydraulic control lines for the further control pressures acting against the counter-pressures. The electronic control unit, preferably constituted as a microcomputer, the electrical control elements, the measuring detectors—which are preferably formed as inductive travel detectors detecting the respective positions of the setting devices—and the electrical signal lines are simple to install, readily maintained, make possible an uncomplicated location of faults and overall a more exact total power regulation.

Figure 2:
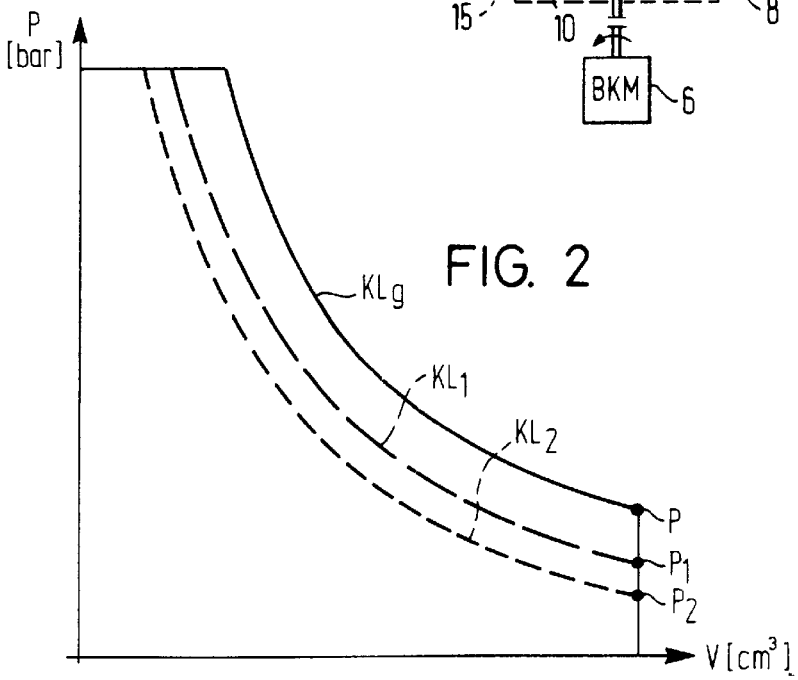

Below, the invention will be described in more detail with reference to a preferred exemplary embodiment and with reference to the drawings, which show:

FIG. 1 a switching diagram of a device for total power regulation of two hydrostatic variable displacement pumps, and FIG. 2 a diagram which illustrates the torque characteristic line of the hydrostatic variable displacement pump according to FIG. 1.

The hydrostatic variable displacement pumps 1 and 2 represented in FIG. 1, such as e.g. axial piston pumps of swashplate construction, are connected via respective working lines each to a consuming unit (not shown) such as for example the travel drive and the swing gear motor of an excavator, and are connected via respective suction lines 4 to a tank 5. The two variable displacement pumps 1, 2 are driven by a common drive motor 6, such as for example a combustion motor, and rotate with the same speed of rotation. For adjusting their displacement volumes there are provided respective setting devices consisting each of two single-acting hydraulic setting cylinders 7, 8.

In each setting cylinder 7, 8 there is displaceably arranged a setting piston 9 which is connected via a piston rod 10 with a setting member 11 or 12 of the respective variable displacement pump 1 or 2. Each setting piston 9 bounds with its larger piston face, away from the piston rod 10, a pressure chamber 13 in the respective setting cylinder 7 or 8. The pressure chambers 13 of the setting cylinders 7 are connected via respective setting pressure lines 14 to the respective working lines 3 associated with the respective variable displacement pumps 1 and 2. From these working lines 3 respective pressure lines 15 lead to the pressure chambers 13 of the setting cylinders 8 in which respective compression springs 16 are arranged which—if appropriate supported by means of the working pressure taken off from the respective working lines 3 via the respective pressure lines 15—each act via the piston 9, the piston rod 10 and the setting member 12 upon the swashplate of the respective variable displacement pump 1 or 2 in the direction of maximum displacement volume. The piston surfaces of the setting pistons 9 in the setting cylinders 7 facing away from the piston rods 10 are greater than those of the setting pistons 9 arranged in the setting cylinders 8 so that the working pressures which build up as setting pressures in the pressure chambers 13 of the setting cylinders 7 during the operation of the variable displacement pumps 1, 2, via the setting pressure lines 14, adjust the swashplates of the respective variable displacement pumps 1, 2 in the direction of minimum displacement volume via the piston 9 and the piston rod 10. Respective adjustable stops 17 in the pressure chambers 13 of the setting cylinders 7 serve for the purpose of restricting the maximum displacement volumes of the variable displacement pumps 1, 2 to different values.

Respective regulation valves 18 are arranged in the setting pressure lines 14 and divide these lines into respective setting pressure line sections 19, 20 leading to the respective working lines 3 and to the respective setting cylinders 7. Each regulation valve 18 is formed as a continuously variable displacement 3/2-way valve and has two working connections to the setting pressure lines 19 and 20 and a working connection to a relief line 21 leading to the tank 5, into which relief line the leakage oil line 22 of the respective variable displacement pump 1 or 2 opens out. In the initial position shown in FIG. 1, the working connection to the setting pressure line section 19 is blocked while the remaining working connections are open. From each setting pressure line section 19, a control pressure line 23 leads to a control connection of the associated regulation valve 18 and makes possible its adjustment in the direction of an end position in which the working connections to the setting pressure line section 20 and the relief line 21 are open and the remaining working connections are blocked.

The device for the total power regulation of the two variable displacement pumps 1, 2 includes two electrical control elements 24, two measuring detectors 25, an electronic control unit 26 and a desired value setting device 27 associated with the control unit.

The electrical control elements 24 are formed as force-regulated proportional magnets and are associated with respective ones of the regulation valves 18 for the purpose of generating a counter-pressure working against the control pressure. The electrical control elements are connected via respective control signal lines 28 with the electronic control unit 26.

The measuring detectors 25 are formed as inductive displacement detectors which for the purpose of detecting the respective set displacement volumes of the variable displacement pumps 1, 2 are associated with the piston rods 10 of the respective setting cylinders 7 and are connected via respective signal lines 29 to the electronic control unit 26.

The electronic control unit 26 is formed as a microcomputer in the memory part of which the characteristic line $KL_g$ shown in FIG. 2 is stored. Although this characteristic line shows the working pressure p in dependence upon the displacement volume V of an variable displacement pump, this characteristic line is described below as torque characteristic line because of its typical development for torque regulation or power regulation. In the present exemplary embodiment, both variable displacement pumps 1, 2 and thus their torque characteristic lines are identical, so that only one of these characteristic lines is stored in the memory part of the microcomputer 26.

The area defined by the product pxV below the torque characteristic line $KL_g$ is constant for each displacement volume V or for each working pressure p and in the present exemplary embodiment is equal to the total drive torque of the drive motor 6. The point P on the torque characteristic line $KL_g$ designates the transition from so-called start-up region (vertical section of $KL_g$) to the regulation region (hyperbolic section of $KL_g$), and its value on the ordinate corresponds to the desired value of the counter-pressure at the regulation valve 18 which is associated with that variable displacement pump 1 or 2 which is transmitting or should transmit the total drive torque. Thus, the value on the ordinate of the point P corresponds to the maximum torque that this variable displacement pump can transmit, e.g. in the present case the total drive torque of the drive motor 6. The desired value of the counter-pressure at the regulation valve associated with the respective other variable displacement pump is set to zero in order to prevent that this variable displacement pump overloads the drive motor 6 through driving the consumer unit connected to this variable displacement pump.

The desired value sum of these two counter-pressure desired values and thus the sum of the torques of the two variable displacement pumps 1, 2, which may not be greater than the total drive torque of the drive motor 6, is likewise stored in the memory part of the microcomputer 26 and can be divided by means of the desired value setting device into desired values of arbitrary magnitudes.

The functioning of the device in accordance with the invention is as follows:

Both of the variable displacement pumps 1, 2, set to maximum displacement volume by means of the compression springs 16, are driven by the drive motor 6 with the same speed of rotation. With the desired value setting device 27 the desired value sum of the counter-pressure desired values for the two regulation valves 18, stored in the microcomputer 26 and corresponding to the total drive torque of the drive motor 6, is divided in accordance with the desired mode of operation and thus determines for each variable displacement pump 1, 2 the maximum torque that it can generate—by way of example 60 percent of the total drive torque for the variable displacement pump 1 and 40 percent for the variable displacement pump 2. The microcomputer 26 sets up for both variable displacement pumps 1, 2 the torque characteristic lines corresponding to the predetermined counter-pressure desired values, e.g. those characteristic lines whose transitions from their vertical sections to their hyperbolic sections are indicated by the points $P_1$ and $P_2$, the values on the ordinate of which points correspond to the predetermined counter-pressure desired values. There is thus provided in the case of the variable displacement pump 1 the characteristic line $KL_1$ of the torque corresponding to the counter-pressure desired value of 60 percent of the desired value total, and in the case of the variable displacement pump 2 the characteristic line $KL_2$ of the torque corresponding to the counter-pressure desired value of 40 percent of the desired value total. The microcomputer 26 effects the setting of the characteristic lines KL corresponding to the predetermined counter-pressure desired values by means, in the exemplary embodiment here described, of sinking of the hyperbolic section of KLg down to the points $P_1$, $P_2$; however, other possibilities are conceivable such as, for example, a selection from a stored set of characteristic lines, which set covers all characteristic lines corresponding to the possible divisions of the desired value total. Now, the microcomputer 26 processes each of these two predetermined desired values to a corresponding control signal and sends this out to the proportional magnets 24 of the respective associated regulation valves 18, which generate corresponding counter-pressures.

So long as the control pressures taken off from the working pressures in the working lines 3 are smaller than the counter-pressure desired values set at the regulation valves, the regulation valves 18 remain in their initial positions and thus set the variable displacement pumps 1, 2 to maximum displacement volumes. As soon as the control pressures equal the set counter-pressure desired values, both variable displacement pumps 1, 2 load the drive motor 6 with the maximum torque to which they are set and in this way together load the drive motor with the total drive torque which the drive motor 6 produces.

If the control pressures exceed the set counter-pressures, each regulation valve 18 responds correspondingly to the control pressure and regulates the setting pressure action on the associated setting device in the direction of reduction of displacement volume of the associated variable displacement pump along the hyperbolic section of the respective torque characteristic lines $KL_1$, or $KL_2$. Thereby, the measuring detectors 25 detect the respective positions of the setting pistons 9 of the setting cylinders 7 and thus the displacement volumes of the respectively associated variable displacement pumps 1 and 2 and generate corresponding signals. The electronic control unit 26 takes up these signals and derives therefrom, for each variable displacement pump 1, 2, that working pressure p which—on the associated torque characteristic line $KL_1$ or $KL_2$—corresponds to the displacement volume V detected by the respective measuring detector 25. This working pressure p is processed in the microcomputer 26 to a corresponding control signal and sent out to the respectively associated proportional magnets 24 for the generation of a correspondingly higher counter-pressure at the respective regulation valve 18. In this way, both variable displacement pumps 1, 2—both individually and also together—are swung back towards smaller displacement volume with increase of the working pressure generated from them in such a way that the individual drive torques corresponding to the set counter-pressure desired values, or the total drive torque corresponding to the desired value total, is not exceeded.

Of course, the desired value total stored in the memory part of the microcomputer 26 may be divided, by means of the desired value setting device 27, in other ways than the above-explained individual desired values, so that it is for example possible to set the variable displacement pump 1 to 100 percent of the total drive torque, for example for driving the vehicle drive, and correspondingly to set the variable displacement pump 2 to zero percent of the total drive torque. In the case that solely the swing gear drive motor should be driven, the variable displacement pump 2 is set to 100 percent and the variable displacement pump 1 correspondingly to zero percent of the total drive torque.

In an alternative configuration, there may be associated with the proportional magnets respective compression springs so that the counter-pressure at each regulation valve 18 results from the force of the proportional magnet and the setting force of this compression spring. The setting force of each of these compression springs can thereby correspond to the desired value total of the counter-pressure desired values, and in this case each proportional magnet acts in opposite direction, of which one corresponds to the direction of action of the control pressure when this control pressure is smaller than the counter-pressure and its set desired value is smaller than the desired value total, and of which the other corresponds to the direction of action of the compression spring, when the control pressure is greater than the counter-pressure.

We claim:

1. A device for total power regulation of at least two variable displacement hydrostatic pumps (1, 2) driven by a common drive motor (6), each pump delivering into a working line (3), by adjustment of its displacement volume by setting devices (7, 8, 9, 10, 11, 12) which are acted upon by a setting pressure and are biassed towards a maximum displacement volume, a regulation valve (18) for each pump associated with the setting devices, each regulation valve being acted upon, against a counter-pressure, by a control pressure corresponding to a working pressure in the working line (3) of the variable displacement pump (1, 2), adjusted by the setting devices (7, 8, 9, 10, 11, 12) (7–12), and wherein each regulation valve (18), in response to the control pressure being greater than the counter-pressure, regulates the pressure set by the setting devices (7, 8, 9, 10, 11, 12) to reduce the displacement volume of each variable displacement pump (1, 2) to maintain constant the product of working pressure and displacement volume, characterized by, a an electronic control unit (26), having a memory means for storing, for each variable displacement pump (1, 2), data defining characteristic lines (KL)—of working pressure p in dependence upon displacement volume V—of constant torque, and the desired value totals of counter-pressures at the regulation valves (18), b the electronic control unit (26) includes a desired value setting means (27) for dividing the desired value total into desired values of magnitude associated with each variable displacement pump, and sets—according to the counter-pressure predetermined desired values—the characteristic lines ($KL_1$, $KL_2$), and processes predetermined desired values to a control signal for the electrical control element (24) to generate a corresponding counter-pressure at the regulation valve (18), c measuring detector means (25), connected to the electronic control unit (26), for detecting the displacement of each variable displacement pump (1, 2), and d the electronic control unit (26), upon response of each regulation valve (18), determines—through computation and solely on the basis of the characteristic line ($KL_1$ or $KL_2$) set for each variable displacement pump (1 or 2)—a desired working pressure (p) which corresponds on the characteristic line ($KL_1$, $KL_2$) to the displacement volume (V) which is determined from the displacement detected by the measuring detector (25), and the control unit processes the desired working pressure (p) to a control signal for the control element (24) to generate a counter-pressure at the regulation valve (18).

2. A device according to claim 1, characterized in that, the electronic control unit (26) is a microcomputer.

3. A device according to claim 2, characterized in that, each easuring detector (25) is an inductive displacement detector which detects the position of the setting devices (4, 7).

4. A device according to claim 3, characterized in that, the electrical control element (24) comprises force-regulated proportional magnets.

5. A device according to claim 1, characterized in that, each measuring detector (25) is an inductive displacement detector which detects the position of the setting devices ( 4, 7).

6. A device according to claim 1, characterized in that, the electrical control element (24) comprises force-regulated proportional magnets.

* * * * *